US006170721B1

(12) United States Patent
Chen

(10) Patent No.: US 6,170,721 B1
(45) Date of Patent: Jan. 9, 2001

(54) FLEXIBLE TOY DOLL AND CLOTHES RACK ASSEMBLY

(76) Inventor: Chao-Yang Chen, 8F-3, No. 321, Fu Shin S. Rd., Sec. 1, Taipei (TW)

( * ) Notice: Under 35 U.S.C. 154(b), the term of this patent shall be extended for 0 days.

(21) Appl. No.: 09/472,785

(22) Filed: Dec. 28, 1999

(51) Int. Cl.[7] ..... A47G 25/14
(52) U.S. Cl. ..... 223/85; 223/94; 223/DIG. 4
(58) Field of Search ..... 223/85, 92, 89, 223/94, DIG. 4; 446/73

(56) References Cited

U.S. PATENT DOCUMENTS 5,201,443 * 4/1993 Oswald ..... 223/85
5,503,311 * 4/1996 Chen ..... 223/85
5,538,166 * 7/1996 Ogawa et al. ..... 223/85
5,577,644 * 11/1996 Chen ..... 223/85
5,601,219 * 2/1997 Chen ..... 223/85

* cited by examiner

*Primary Examiner*—Bibhu Mohanty
(74) *Attorney, Agent, or Firm*—Bacon & Thomas, PLLC

(57) ABSTRACT

A flexible toy doll and clothes rack assembly, which includes a flexible framework being bendable to the desired shape, a doll covered on the flexible framework, coupling means, and support means detachably coupled to the framework by the coupling means. A bendable doll is left after removal of the support means from the framework.

7 Claims, 8 Drawing Sheets

FLEXIBLE TOY DOLL AND CLOTHES RACK ASSEMBLY

BACKGROUND OF THE INVENTION

The present invention relates to a clothes rack, and more particularly to a flexible toy doll and clothes rack assembly.

A regular toy doll is comprised of a covering (fur) having the shape of an animal or carton character, and stuffing material, such as cotton, sponge, rags, etc. stuffed in the covering. This kind of toy doll is great favorite of people since long for the advantages of high softness and safeness, low cost, and attractive appearance. People may attach toy dolls to bags, clothes hangers, slippers, and etc. for decoration. Similar designs of the present inventor are seen in U.S. Pat. No. 5,503,301 entitled "Rotating Clothes Hanger Covered with a Toy Doll; U.S. Pat. No. 5,577,644 entitled "Toy Doll and Hanger Assembly; U.S. Pat. No. 5,601,219 entitled "Clothes Hanger Covered with a Toy Doll.

SUMMARY OF THE INVENTION

The present invention provides a flexible toy doll and clothes rack assembly, which is comprised of a flexible framework, a doll covered on the framework, a coupling device, and a support member fastened to the framework through the coupling device. The framework can be bent to the desired shape. According to one embodiment of the present invention, the framework is comprised of at least one base frame, and a plurality of joint units. The at least one base frame each comprises a plurality of ball ends for the coupling of the joint units. The joint units each comprise a ball end and a socket end. The socket end at one joint unit fits the ball end at another socket unit and the ball ends at the at least one base frame for enabling the joint units to be connected to one another and connected to the at least one base frame. Alternatively, the framework can be comprised of a plurality of metal (iron, aluminum, or metal alloy) wire rods that can be bent to the desired shape. The framework can have any of a variety of designs. For example, the framework can be the base frame of a suit hanger, multi-rod clothes line, skirt hanger, socks hanger, shoe rack, toy eagle, toy octopus, toy bear, toy mouse, toy duck, etc. The coupling device enables the support member to be detachably fastened to the framework. Detachable arrangement between the coupling device and the support member can be variously embodied, and achieved by conventional techniques. For example, the support member can be detachably fastened to the coupling device by a screw joint, or plug joint. The doll can have the shape of any character. The doll comprises a covering with stuffing or without stuffing. The covering of the doll has a through hole for the mounting of the coupling device. The coupling device is comprised of a socket member fastened to the framework, and a plug member fastened to the socket member to receive the support member. The socket member comprises an outward top flange disposed inside the covering of the doll. The plug member comprises an outward top flange disposed outside the covering of the doll and pressed on the covering of the doll around the through hole against the outward top flange of the socket member. After installation of the coupling device in the framework, the covering of the doll around the through hole is well protected by the coupling device. The support member can be a swivel hook, a stand, a hanging rod, a hanging loop, etc.

DETAILED DESCRIPTION OF THE PREFERRED EMBODIMENTS

Figure 1:
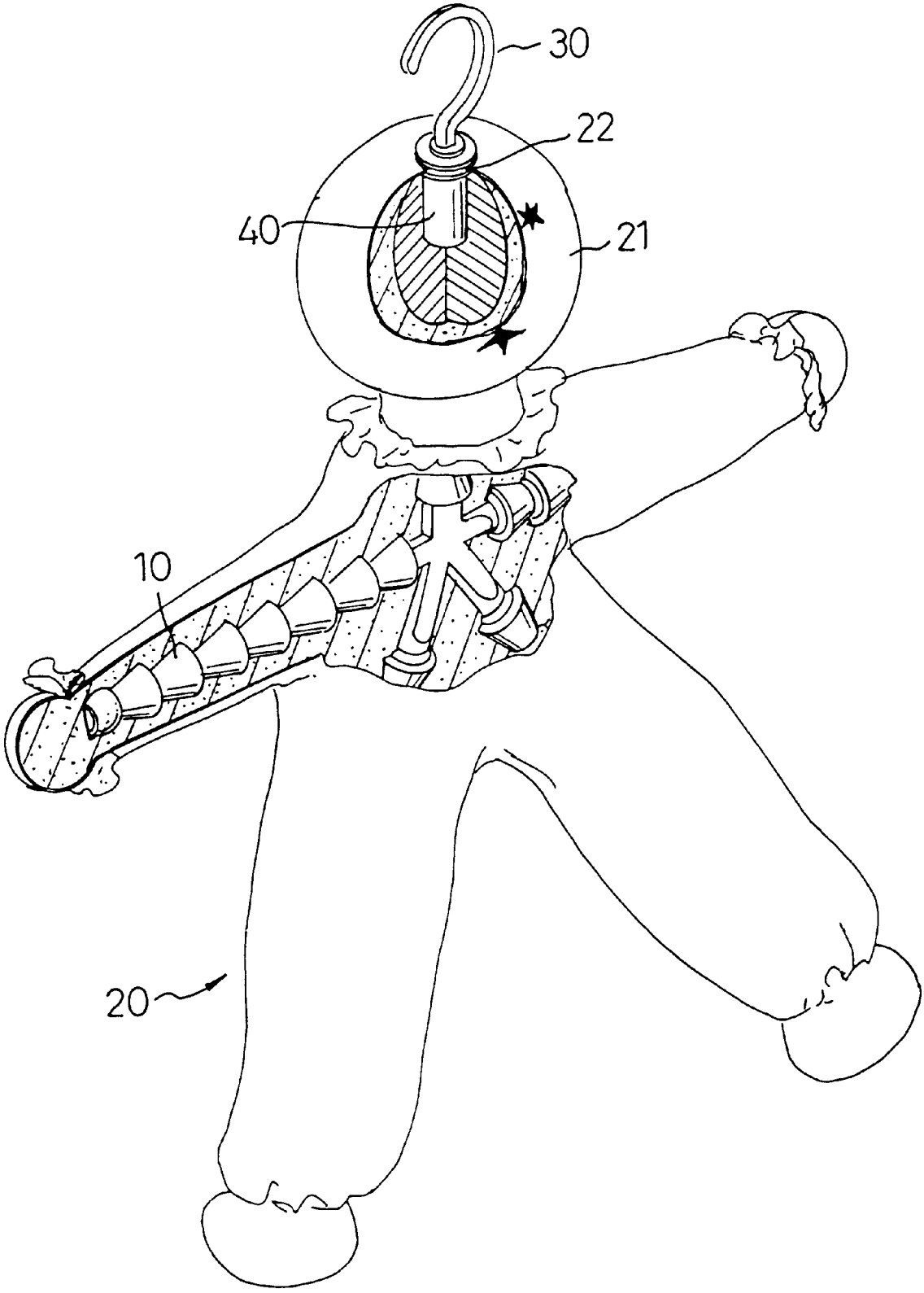
FIG. 1 is a partially sectional view of a toy doll and clothes rack assembly according to a first embodiment of the present invention.
Figure 2:
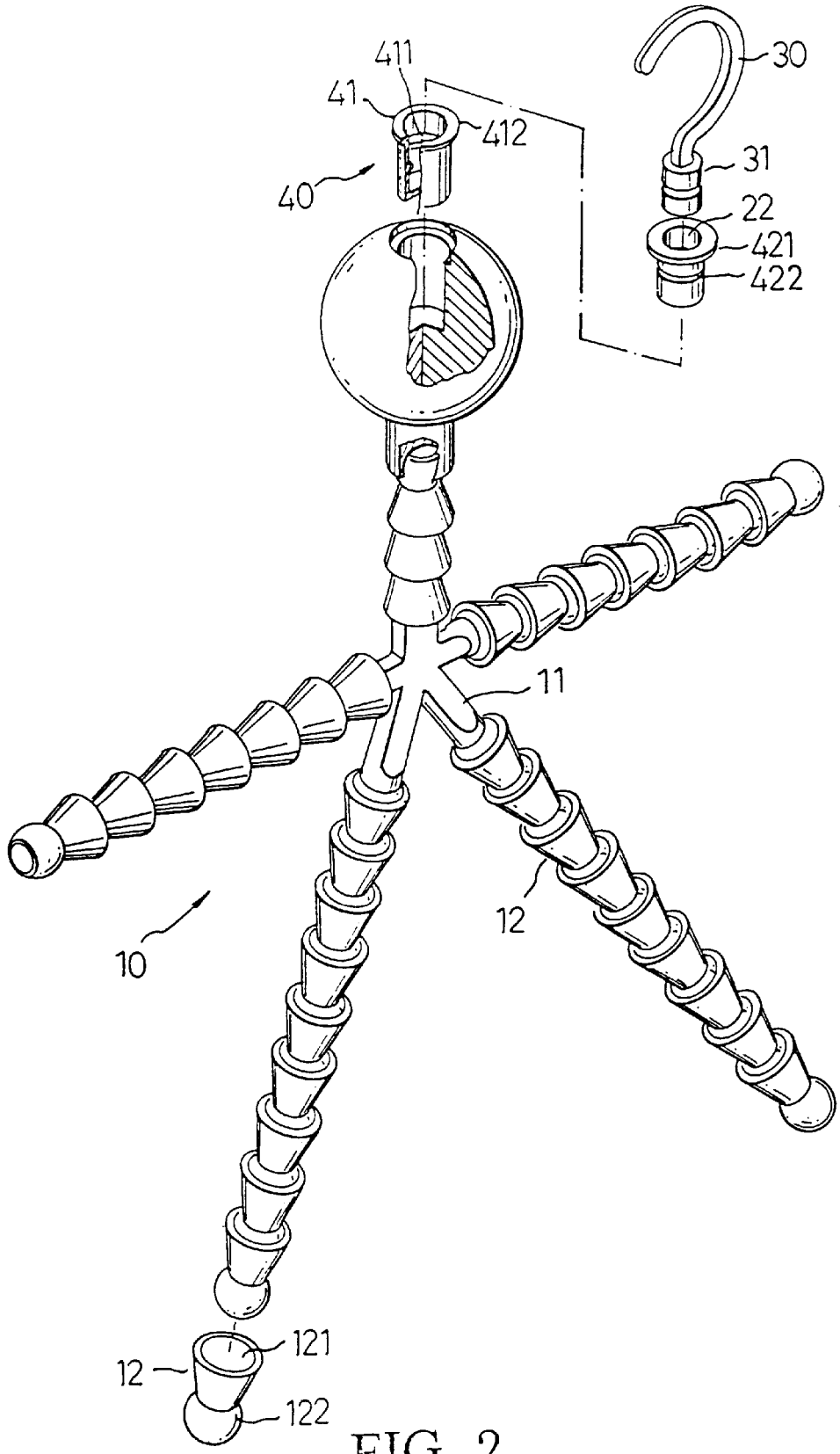
FIG. 2 is an exploded view of the framework, the coupling device, and the support member for the toy doll and clothes rack assembly according to the first embodiment of the present invention.

Referring to FIGS. 1 and 2, a toy doll and clothes rack assemble according to a first embodiment of the present invention is shown comprised of a framework 10, a doll 20, a support member 30, and a coupling device 40. The framework 10 is flexible, and can be bent to the desired shape. The doll 20 can have the shape of any of a variety of characters, and is covered on the framework 10. A through hole 22 is made on the covering 21 of the doll 20 for receiving the coupling device 40. The support member 30 according to this embodiment is a swivel hook detachably connected to the framework 10 through the coupling device 40.

Referring to FIG. 2 again, the coupling device 40 comprises a socket member 41, and a plug member 42. The socket member 41 comprises a top opening 411, and an outward top flange 412 rose around the periphery of the top end thereof. The plug member 42 is fitted into the top opening 411 on the socket member 41, having a coupling hole 422 and an outward top flange 421 raised around the periphery of the top end thereof. After installation of the plug member 42 in the socket member 41, the coupling device 40 is firmly secured to the doll 20, enabling the covering 21 to be sandwiched in between the outward top flange 421 of the plug member 42 and the outward top flange 411 of the socket member 41. The swivel hook 30 comprises a bottom connector 31 coupled to the coupling hole 422 on the plug member 42.

Referring to FIGS. 1 and 2 again, the framework 10 comprises a base frame 11, a plurality of joint units 12, and a head unit 13. The coupling device 40 is fastened to the head unit 13. The joint units 12 each comprise a ball end 122, and a socket end 121. The joint units 12 can be connected to one another by coupling the ball end 122 at one joint unit 12 to the socket end 121 at another. The base frame 11 has multiple ball ends for the coupling of the joint units 12.

Figure 3:
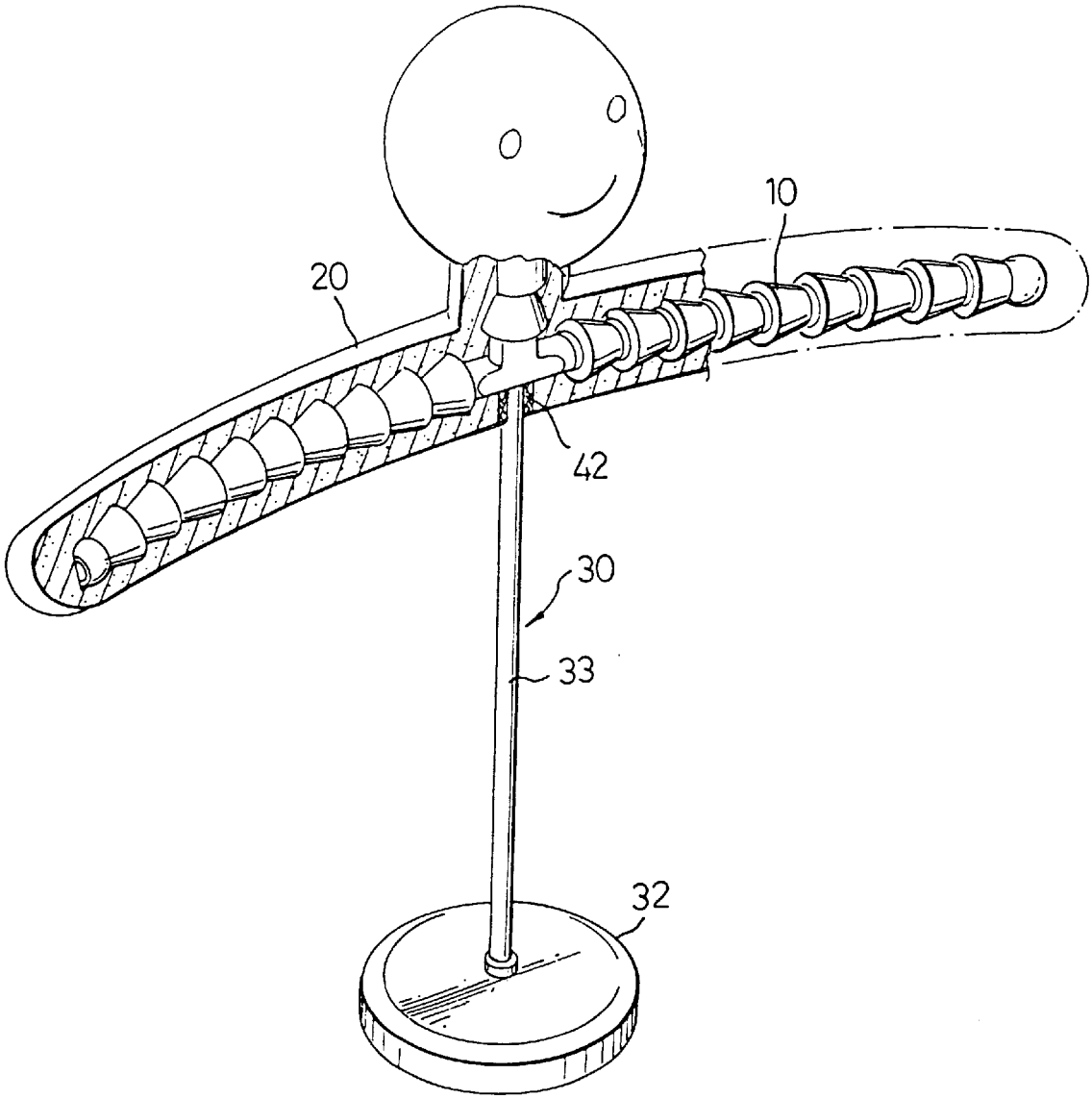
FIG. 3 is a partially sectional view of a toy doll and clothes rack assembly according to a second embodiment of the present invention (the support member is a stand).

FIG. 3 shows a toy doll and clothes rack assembly according to a second embodiment of the present invention. According to this embodiment, the doll 20 is covered on the framework 10, and the framework 10 is supported on the support member 30. The support member 30 according to this embodiment is a stand comprised of a base 32, and a stem 33 perpendicularly extended from the base 32 at the top. The top end of the stem 33 is fastened to the plug member 42 in the socket member 41 (not shown) at the framework 10.

Figure 4:
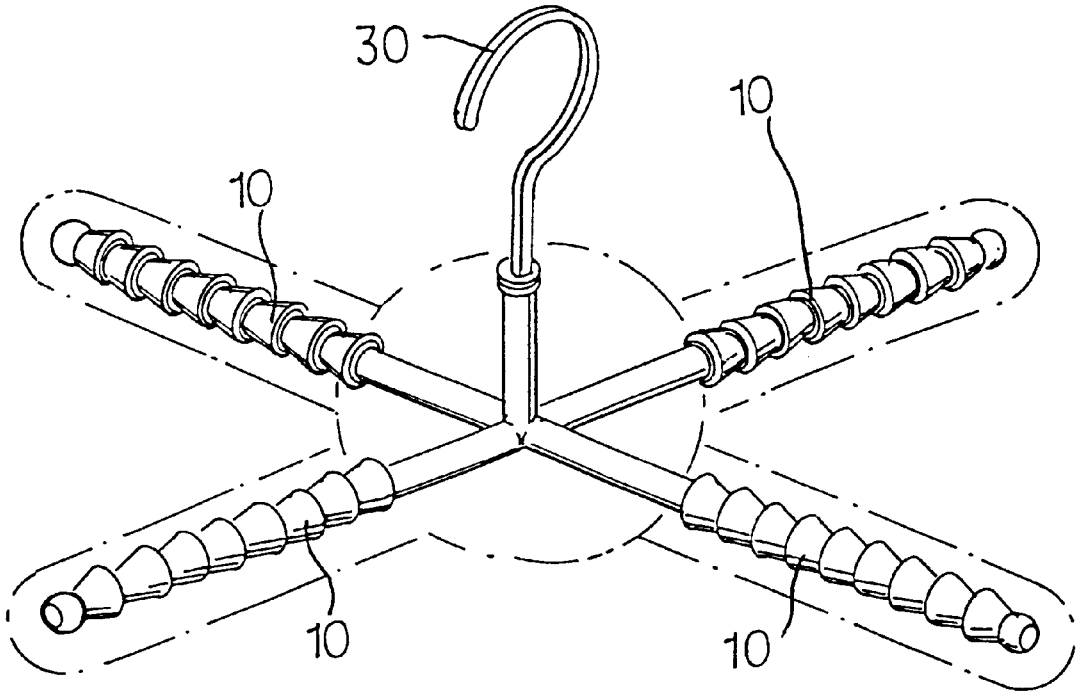
FIG. 4 illustrates a toy doll and clothes rack assembly according to a third embodiment of the present invention (the framework comprises four clothes rods).

FIG. 4 shows a toy doll and clothes rack assembly according to a third embodiment of the present invention. According to this embodiment, the support member 30 is a swivel hook, and the framework 10 comprises four clothes rods, each clothes rod comprised of a plurality of joint units connected in series.

Figure 5:
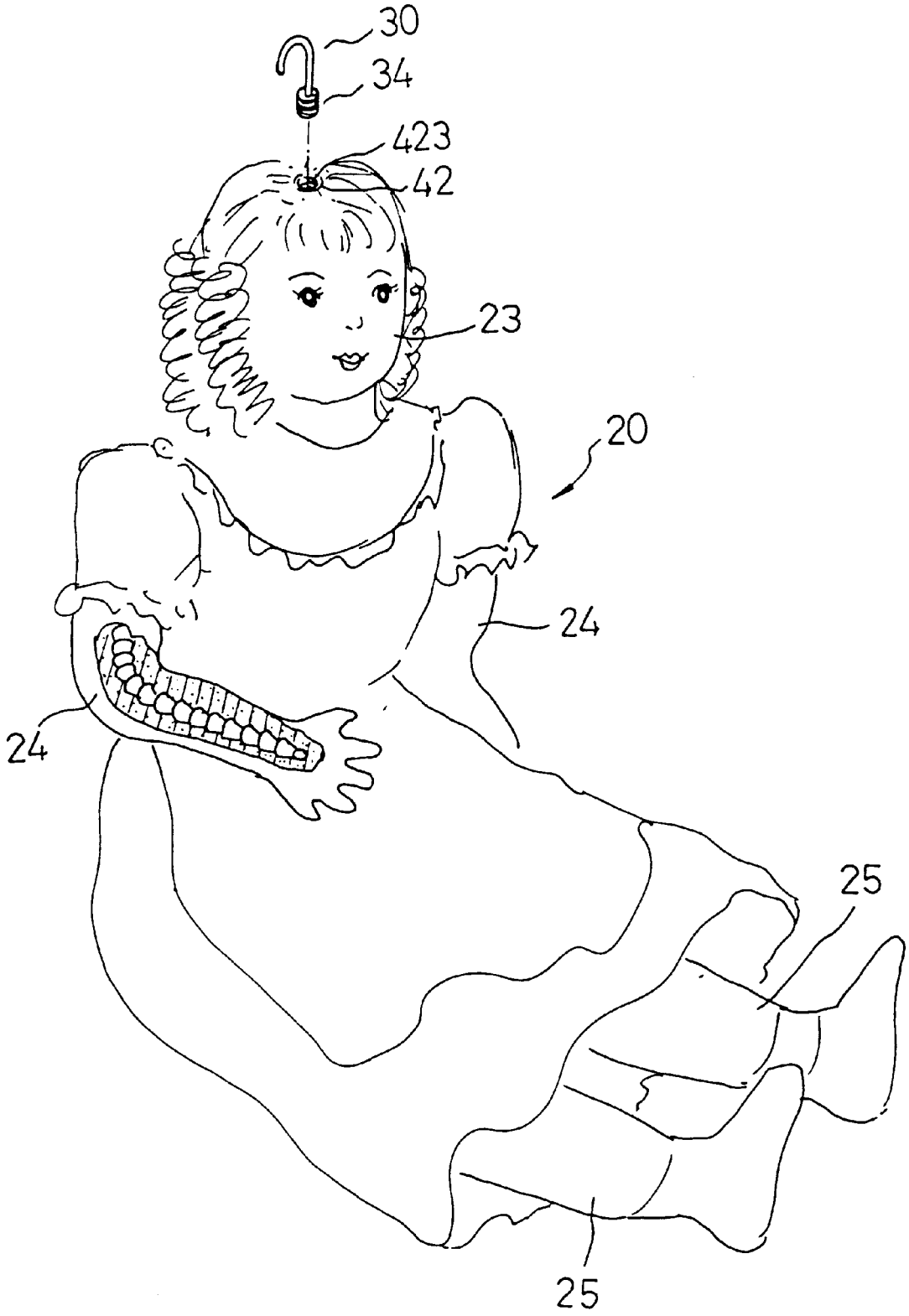
FIG. 5 illustrates a toy doll and clothes rack assembly according to a fourth embodiment of the present invention (the support member is a hook).

FIG. 5 shows a toy doll and clothes rack assembly according to a fourth embodiment of the present invention. According to this embodiment, the support member 30 is a hook having a bottom screw rod 34 threaded into a screw hole 423 on the plug member 42 in the socket member 41 (not shown) at the head 23 of the doll 20. After removal of the support member 30 from the doll 20, the arms 24 and legs 25 of the doll 20 can be bent to different angles. The screw hole 423 is small, and can be kept from sight by the hairs at the head 23 of the doll 20.

Figure 6:
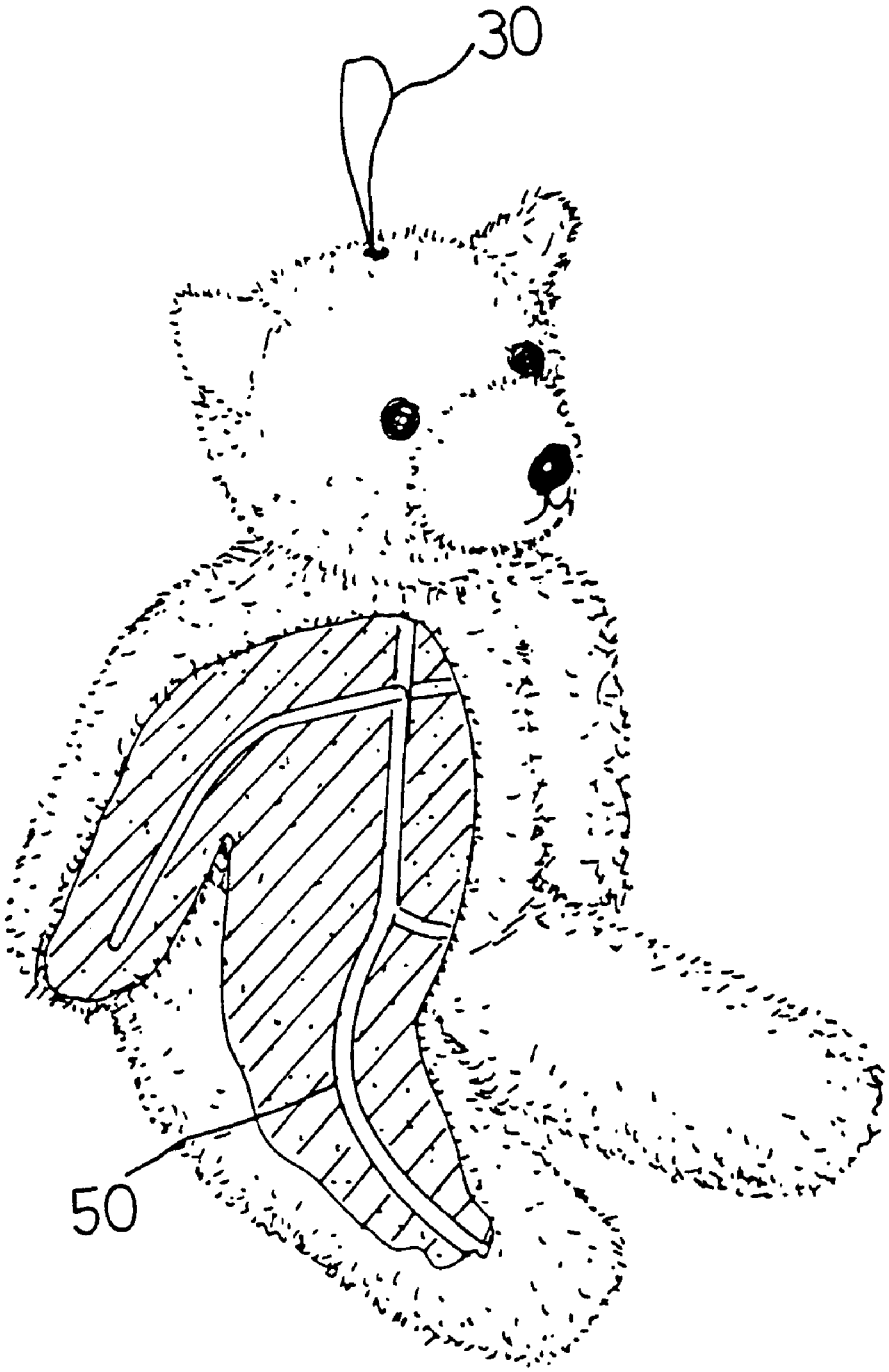
FIG. 6 illustrates a toy doll and clothes rack assembly according to a fifth embodiment of the present invention (the framework is comprised of a plurality of metal wire rods that can be bend to the desired shape).

FIG. 6 shows a toy doll and clothes rack assembly according to a fifth embodiment of the present invention. According to this embodiment, the framework 10 is formed of resilient metal wire rods 50 that can be bent to the desired shape.

Figure 7:
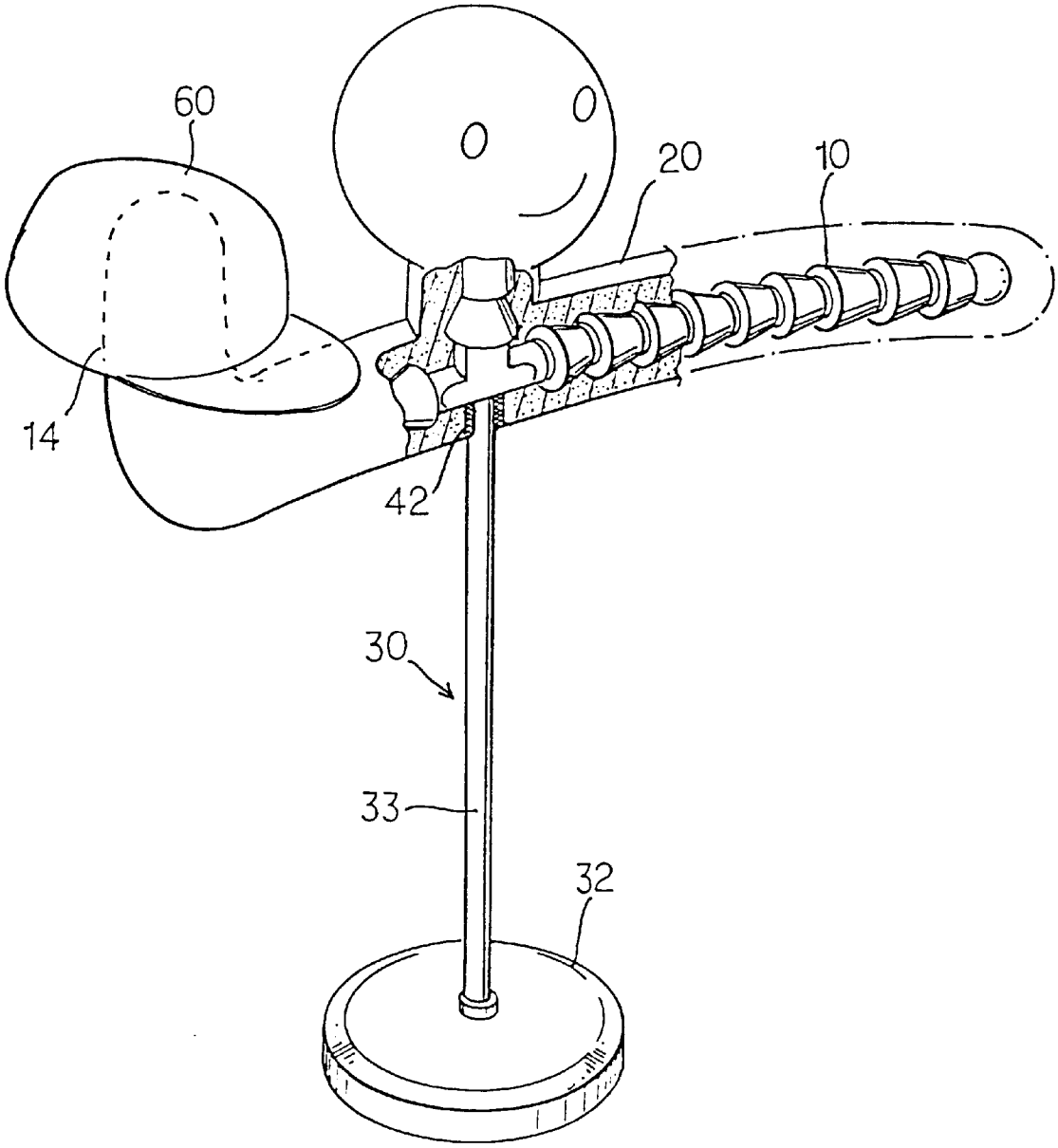
FIG. 7 shows an application example of the second embodiment of the present invention.

FIG. 7 shows an application example of the second embodiment shown in FIG. 3. According to this application example, one arm 14 of the doll 20 is bent to an angled shape to hold a cap 60.

Figure 8:
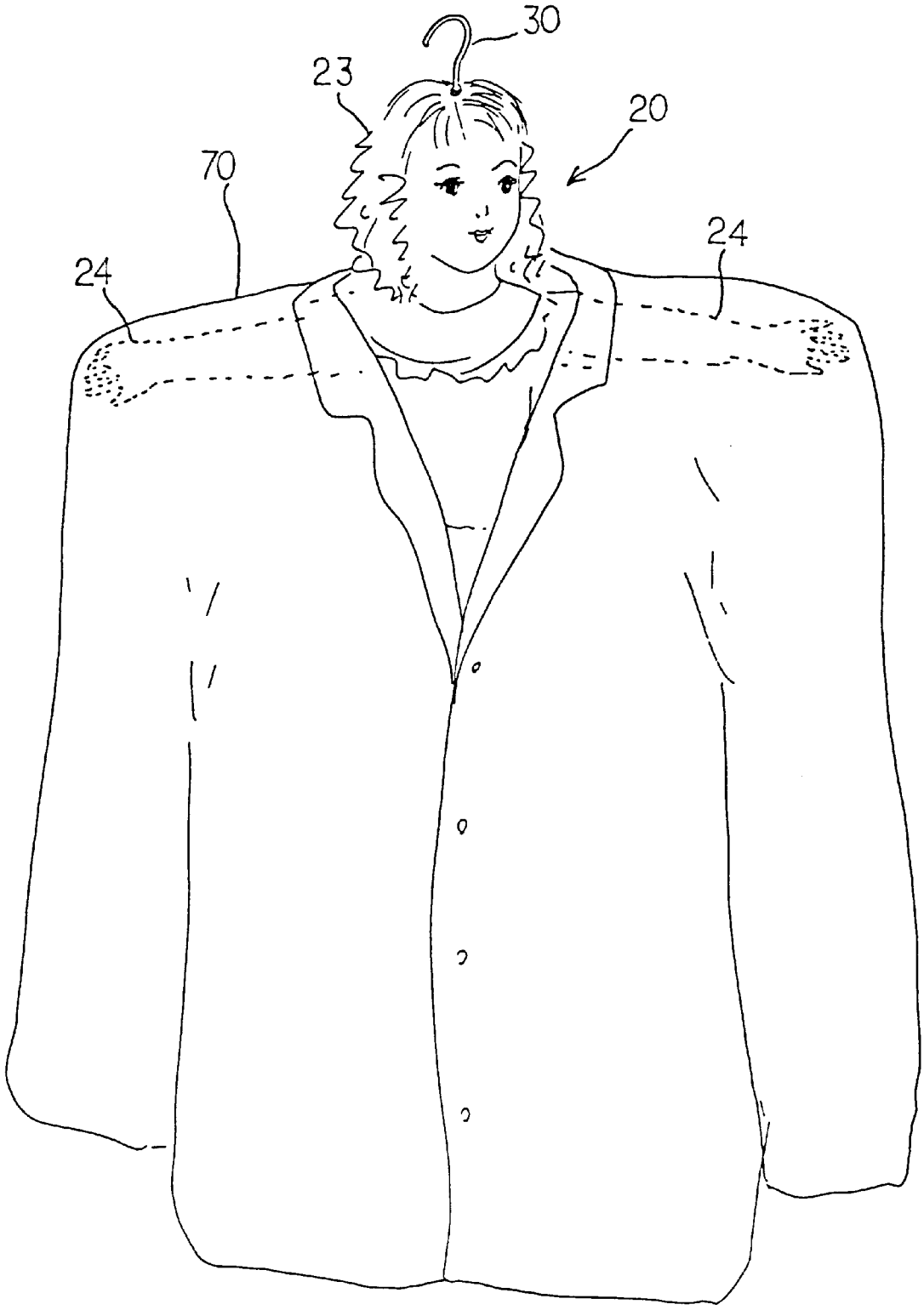
FIG. 8 shows an application example of the fourth embodiment of the present invention.

FIG. 8 shows an application example of the fourth embodiment shown in FIG. 5. When the arms 24 of the doll 20 are extended out, a piece of clothing 70 can then be hung on the doll 20.

It is to be understood that the drawings are designed for purposes of illustration only, and are not intended for use as a definition of the limits and scope of the invention disclosed.

What the invention claimed is:

1. A flexible toy doll and clothes rack assembly comprising:

a flexible framework being bendable to the desired shape, said flexible framework comprises at least one base frame and a plurality of joint units, said at least one base frame each comprising a plurality of ball ends for the coupling of said joint units, said joint units each comprising a ball end and a socket end, the socket end of one joint unit fitting the ball end of another socket unit and the ball ends of said at least one base frame for enabling said joint units to be connected to one another and connected to said at least one base frame;

a doll covered on said flexible framework, said doll comprising a covering and a through hole on said covering;

support means detachably coupled to said framework; and coupling means inserted through said through hole on said covering and fastened to said framework to secure said support means of said framework.

2. The flexible toy doll and clothes rack assembly of claim 1 wherein said coupling means comprises a socket member fastened to said framework, said socket member comprising a top opening and an outward flange disposed inside the covering of said doll, and a plug member inserted through the through hole on the covering of said doll and fastened to the top opening on said socket member to hold said support means, said plug member comprising an outward flange pressed on the covering of said doll against the outward flange of said socket member.

3. The flexible toy doll and clothes rack assembly of claim 2 wherein said support means comprises a hook, and a connector provided at one end of said hook and coupled to said plug member of said coupling means.

4. The flexible toy doll and clothes rack assembly of claim 2 wherein said support means is a stand comprised of a base and a stem extended from said base and coupled to said plug member of said coupling means.

5. The flexible toy doll and clothes rack assembly of claim 1 wherein said flexible framework further comprises a head to which said coupling device is connected, and the number of said at least one base frame is 1.

6. The flexible toy doll and clothes rack assembly of claim 1 wherein said support means is a swivel hook, and said joint units are fastened to said at least one base frame, forming a plurality of clothes rods.

7. The flexible toy doll and clothes rack assembly of claim 1 wherein said flexible framework is comprised of a plurality of metal wire rods being bendable to the desired shape.

* * * * *